US006921461B2

(12) United States Patent
Watanabe et al.

(10) Patent No.: US 6,921,461 B2
(45) Date of Patent: Jul. 26, 2005

(54) ELASTIC BELT FOR PAPERMAKING

(75) Inventors: Atsuo Watanabe, Hirakata (JP); Takahisa Hikida, Hirakata (JP); Atsushi Watanabe, Hirakata (JP)

(73) Assignee: Yamauchi Corporation, Osaka (JP)

( * ) Notice: Subject to any disclaimer, the term of this patent is extended or adjusted under 35 U.S.C. 154(b) by 0 days.

(21) Appl. No.: 10/450,133

(22) PCT Filed: Nov. 22, 2001

(86) PCT No.: PCT/JP01/10259

§ 371 (c)(1),
(2), (4) Date: Jun. 12, 2003

(87) PCT Pub. No.: WO02/48456

PCT Pub. Date: Jun. 20, 2002

(65) Prior Publication Data

US 2004/0026057 A1 Feb. 12, 2004

(30) Foreign Application Priority Data

Dec. 13, 2000 (JP) ..... 2000-378479

(51) Int. Cl.[7] ..... D21F 3/00; D21G 9/00

(52) U.S. Cl. ..... 162/358.4; 162/901; 428/157; 428/161; 428/163; 428/167; 442/65

(58) Field of Search ..... 162/306, 348, 162/358.1, 358.2, 358.3, 358.4, 900–904; 428/156, 157, 16, 163, 167; 442/64–71, 104, 105

(56) References Cited

U.S. PATENT DOCUMENTS

| | | | | | |
|---|---|---|---|---|---|
| 4,559,258 A | | 12/1985 | Kiuchi | | |
| 5,134,010 A | | 7/1992 | Schiel | | |
| 5,766,421 A | * | 6/1998 | Aufrecht | 162/358.4 | |
| 5,943,951 A | * | 8/1999 | Muellner et al. | 100/37 | |
| 6,042,695 A | | 3/2000 | Ishino | | |
| 6,699,368 B2 | * | 3/2004 | Ishii et al. | 162/358.4 | |

FOREIGN PATENT DOCUMENTS

| | | | | | |
|---|---|---|---|---|---|
| EP | 0 877 118 A2 | | 11/1998 | | |
| EP | 0 886 004 A1 | | 12/1998 | | |
| EP | 0 978 588 A2 | | 2/2000 | | |
| JP | 59-54598 U | | 4/1984 | | |
| JP | 4-119191 A | | 4/1992 | | |
| JP | 04-119191 | * | 4/1992 | D21F/3/02 | |
| JP | 2542250 B2 | | 7/1996 | | |
| JP | 11-12975 A | | 1/1999 | | |
| JP | 2889341 B2 | | 2/1999 | | |
| JP | 3045975 B2 | | 3/2000 | | |
| JP | 2000-110090 A | | 4/2000 | | |
| WO | WO 87/02080 A1 | | 4/1987 | | |

* cited by examiner

*Primary Examiner*—Steven P. Griffin
*Assistant Examiner*—Eric Hug
(74) *Attorney, Agent, or Firm*—Birch Stewart Kolasch & Birch, LLP

(57) ABSTRACT

A papermaking belt of improved durability capable of preventing a crack from progressing into the which includes a reinforcing substrate embedded in an elastic material, and the elastic material containing a surface layer, a back layer and an intermediate layer located between the surface layer and the back layer and having a thick part containing a thickness in the belt thickness direction along the belt traveling direction in the said intermediate layer. The thick part can also be exposed on the belt surface through the surface layer, the thick part is preferably made of a low-hardness elastic material and the surface layer is preferably made of a high-hardness elastic material.

12 Claims, 6 Drawing Sheets

ELASTIC BELT FOR PAPERMAKING

This application is the national phase under 35 U.S.C. §371 of PCT International Application No. PCT/JP01/10259 which has an International filing date of Nov. 22, 2001, which designated the United States of America.

TECHNICAL FIELD

The present invention relates to a papermaking elastic belt, and more specifically, it relates to a papermaking elastic belt such as a shoe pressing belt, a calender belt or a sheet transfer belt used in a papermaking step.

BACKGROUND ART

In recent years, the so-called shoe press for dehydrating a wet web by pressing one surface of the wet web placed on a felt member traveling at a high speed with a press roll while pressurizing the other surface with a pressure shoe through an endless belt has been widely used in the press portion of a papermaking step, in order to improve the dehydration efficiency for the wet web. In the shoe press, a belt endlessly formed by integrating a reinforcing substrate and an elastic material such as thermosetting polyurethane with each other is employed. Also in a calender step of smoothing and glossing the surface of paper, employment of an elastic belt similar to the aforementioned one has been recently studied. In addition, employment of a similar elastic belt is studied also as to a sheet transfer belt for preventing a web break and for stably transporting a wet web, particularly when performing papermaking at a high speed. Japanese Utility Model Laying-Open No. 59-54598 or the like discloses a typical structure of such a papermaking belt prepared by forming elastic materials on both surfaces of a fabric base and providing grooves on the surface.

Generally in shoe pressing, for example, severe bending and pressing are repeated on the belt between the press roll and the pressure shoe, and hence the elastic material forming the belt is unavoidably cracked when the belt is used over a long period of time. In general, such cracking is generated from the outer peripheral surface of the belt. A crack once caused progresses into a large crack as the belt is used. When the crack progresses, lubricating oil stored between the inner peripheral surface of the belt and the pressure shoe externally leaks to exert a bad influence on paper or cause delamination of the belt.

On the other hand, the fabric base may be broken by repetition of bending and pressurization in advance of cracking, to cause delamination. Further, delamination may be caused by weakness of adhesion between the fabric base and the elastic material. Thus, the progress of a crack, breakage of the fabric base, weakness of the adhesion between the fabric base and the elastic material etc. reduce the life of the belt.

In order to improve the life of the belt, a solution for the problem of delamination of the belt has been studied. In order to solve the problem of delamination of the belt, Japanese Patent No. 2889341 proposes a dehydration press belt obtained by forming an intermediate elastic layer at least on one surface of a fabric base layer, further forming a surface elastic layer and a back elastic layer on the outer side of the intermediate elastic layer and the other surface of the fabric base layer respectively, and bonding and integrating these elastic layers to and with each other.

According to the aforementioned technique, air remaining in the fabric base layer can be expelled when the fabric base layer is coated with the intermediate elastic layer in the process of manufacturing the belt. Since air can be expelled from the fabric base layer, a belt containing no pinholes between the fabric base layer and the elastic layers can be manufactured. Since the belt can be manufactured to contain no pinholes between the fabric base layer and the elastic layers, an effect, to some extent, can be attained concerning the problem of delamination.

On the other hand, Japanese Patent No. 3045975 discloses a shoe pressing belt prepared by varying the hardness of the resin forming the belt to be high in a central region along the width direction and low in both edge regions for suppressing cracking at the shoe edge portions. However, since the belt disclosed therein has only two elastic layers, i.e., a surface layer and a back layer holding a fabric base therebetween, it is not easy to manufacture a belt not which does contain pinholes, and hence the problem of delamination may still remain. When the central region along the width direction is cracked further, this crack disadvantageously progresses toward the fabric base.

Japanese Patent No. 2,542,250 discloses still another typical structure obtained by embedding reinforcing yarns in an elastic material. Further, U.S. Pat. No. 5,943,951 discloses a belt formed with flexible parts on ends of a press region for preventing cracking on shoe ends in a structure obtained by embedding reinforcing yarns in an elastic material. However, in this belt, when the central region in the width direction is cracked, this crack may also progress into the belt. In particular, when reinforcing yarns are embedded in an elastic material a crack may progress into the inner peripheral surface of the belt when the surface of the belt is cracked.

SUMMARY OF THE INVENTION

An object of the present invention is to provide a papermaking elastic belt capable of preventing a crack from progressing into the belt when the papermaking elastic belt is cracked. Another object of the present invention is to provide a papermaking elastic belt improved in durability by preventing breakage of a reinforcing substrate. Still another object of the present invention is to provide a papermaking elastic belt suitable for employment in a papermaking press.

The papermaking elastic belt according to the present invention is prepared by embedding a reinforcing substrate in an elastic material, while the said elastic material includes a surface layer, a back layer and an intermediate layer located between the said surface layer and the said back layer, and the intermediate layer includes a thick part having a thickness in the belt thickness direction along the belt traveling direction.

The papermaking elastic belt according to the present invention has a thin part located on the surface side of the said thick part and reduced in thickness in the belt thickness direction in the surface layer.

In the papermaking elastic belt according to the present invention, the thick part is preferably exposed on the belt surface through the surface layer.

In the papermaking elastic belt according to the present invention, the intermediate layer is preferably made of a low-hardness elastic material, and the surface layer is preferably made of a high-hardness elastic material.

In the papermaking elastic belt according to the present invention, the durometer hardness (JIS K6253) of the low-hardness elastic material is preferably A80 to A88, and the durometer hardness (JIS K6253) of the high-hardness elastic material is preferably A93 to A99.

In the papermaking elastic belt according to the present invention, grooves can be formed on the outer peripheral surface of the elastic belt.

In the papermaking elastic belt according to the present invention, the bottom of the groove located above the thick part is present in the said intermediate layer, and the bottom of the groove located on a portion not above the said thick part can be formed in the surface layer.

In the papermaking elastic belt according to the present invention, at least part of the said reinforcing substrate can be located in the intermediate layer.

In the papermaking elastic belt according to the present invention, part of the reinforcing substrate can be located in the back layer.

The papermaking elastic belt according to the present invention is a papermaking elastic belt used for a papermaking press comprising a press roll, an elastic belt opposed to the press roll and a pressure shoe located inside the elastic belt for pressing the elastic belt against the said press roll for pressing a material web between the elastic belt and the press roll.

In the papermaking elastic belt according to the present invention, the thick part is preferably formed in a region corresponding to an axial end of the pressure shoe.

In the papermaking elastic belt according to the present invention, the thick part is preferably formed in a region corresponding to an axial end of the press roll.

In the papermaking elastic belt, cracking tends to concentrically take place on a constant portion in the belt width direction. The inventors have completed the present invention on the basis of such new recognition that a crack can be prevented from progressing into the belt by increasing the thickness of the intermediate layer beyond that of the remaining portions where such concentrated generation of cracking is subjected.

In an elastic belt used for a papermaking press comprising a press roll, the elastic belt opposed to the said press roll and a pressure shoe located inside the elastic belt for pressing the elastic belt against the press roll for passing a material web between the elastic belt and the press roll and pressing the material web, cracking concentrically takes place at a region corresponding to the axial end of the pressure shoe or a region corresponding to the axial end of the press roll, for example. Therefore, it is possible to prevent a generated crack from progressing into the belt by increasing the thickness of the intermediate layer beyond that of the remaining portions along the belt thickness direction in such a portion subjected to a concentrated generation of cracking.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DESCRIPTION OF THE INVENTION

Figure 1:
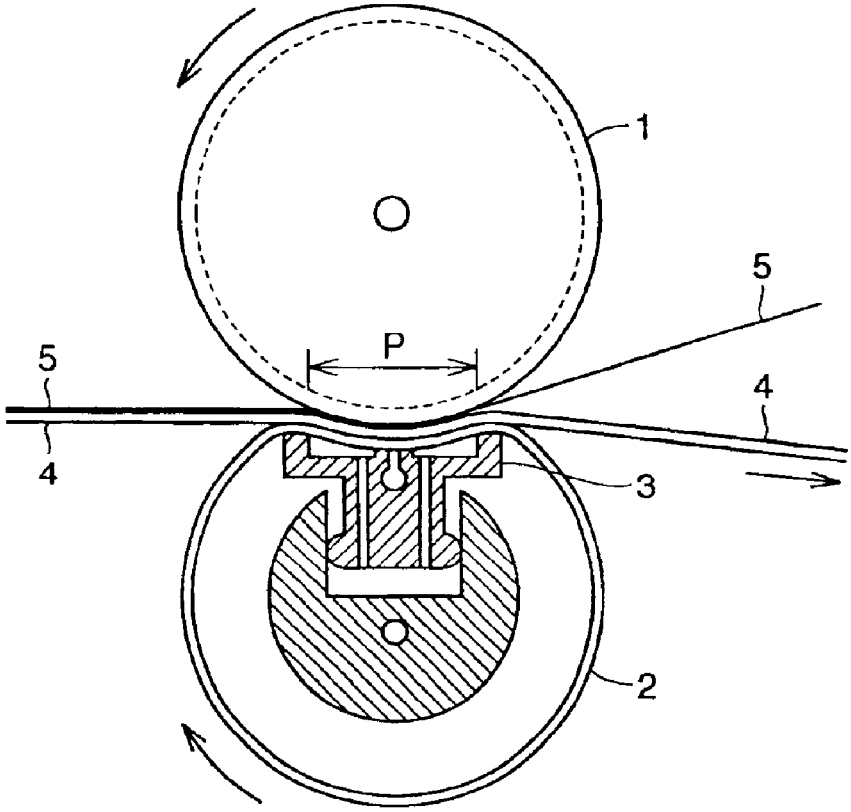
FIG. 1 is an explanatory diagram showing a shoe press.

FIG. 1 shows an exemplary shoe press employed in a press step of a paper machine. Referring to FIG. 1, the shoe press comprises a press roll 1, an elastic belt 2 opposed to the press roll 1, and a pressure shoe 3 located inside the elastic belt 2 for pressing the elastic belt 2 against the press roll 1. Lubricating oil is supplied between the belt 2 and the pressure shoe 3, so that the belt 2 can slide on the pressure shoe 3. A wet web serving as a material web 5 passes between the belt 2 and the press roll 1 in superposition with a felt member 4. The outer peripheral surface of the belt 2 and the felt member 4 are directly in contact with each other. The belt 2 runs while sliding on the pressure shoe 3 due to friction with the felt member 4. The pressure shoe 3 is pressed against the press roll 1 with a prescribed pressure from the inner peripheral surface side of the belt 2. The material web 5 is pressed and dehydrated by this pressing force. The surface of the pressure shoe 3 defines a smooth concave portion corresponding to the surface of the press roll 1. This smooth concave portion forms a wide pressurizing/dehydrating part P between the press roll 1 and the pressure shoe 3.

Figure 2:
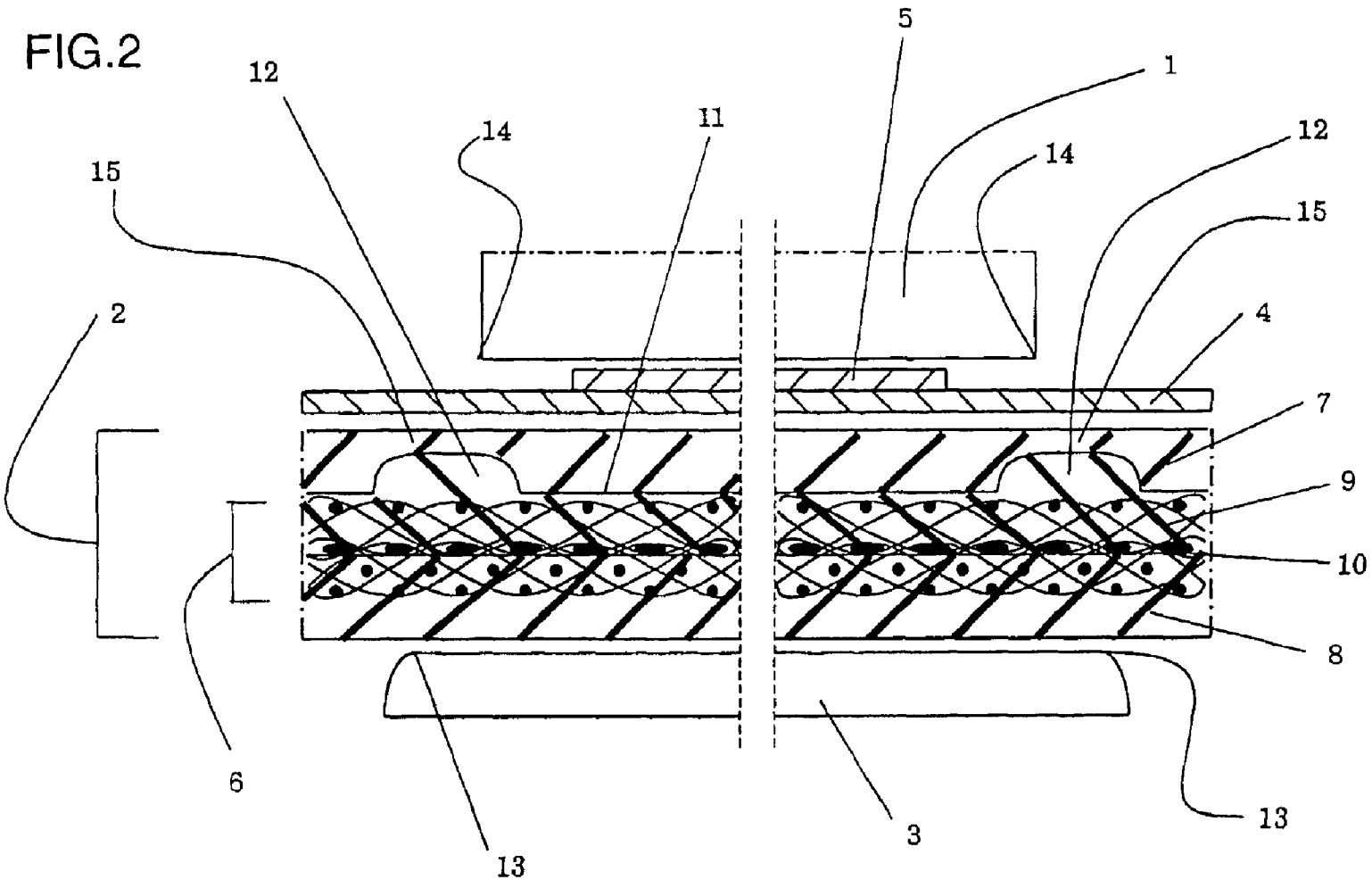
FIG. 2 is a sectional view of a principal part of a shoe press employing a papermaking elastic belt according to an embodiment of the present invention as viewed from the traveling direction.

FIG. 2 is a sectional view of a principal part of a shoe press employing a papermaking elastic belt 2 according to the present invention as viewed from the traveling direction. This belt 2 has an endless shape, and a reinforcing substrate 6 is embedded in an elastic material. In this example, the reinforcing substrate 6 is woven fabric made of organic fiber such as polyamide or polyester. The reinforcing substrate 6 preferably contains a large number of voids, in order to improve the degree of impregnation of the elastic material. For this reason, multi-woven fabric such as quadruple layer woven fabric or triple layer woven fabric is preferably used when employing woven fabric as the reinforcing substrate 6. When multi-woven fabric is employed, the elastic material can be sufficiently infiltrated into the same so that a sufficient anchor effect can be attained between the elastic material and the reinforcing substrate 6 in addition to the excellent strength of the reinforcing substrate 6 itself, whereby delamination can be prevented. Referring to FIG. 2, the reinforcing substrate 6 is made of quadruple layer woven fabric.

The elastic material is formed by a surface layer 7, a back layer 8 and an intermediate layer 9. Referring to FIG. 2, the reinforcing substrate 6 is impregnated and covered with the back layer 8 and the intermediate layer 9 from both surfaces thereof.

The outer side of the intermediate layer 9 is covered and integrated with the surface layer 7. An adhesive surface 10 between the back layer 8 and the intermediate layer 9 is formed in the reinforcing substrate 6. The position of the interface 11 between the intermediate layer 9 and the surface layer 7 is substantially flush with the surface of the reinforcing substrate 6. However, the position of the interface 11 is not restricted to this but may vertically deviate from the surface of the reinforcing substrate 6.

In the papermaking elastic belt 2 according to the present invention, the elastic material is formed by at least three layers. In the present invention, the layer located between the surface layer 7 and the back layer 8 is defined as the intermediate layer 9. The intermediate layer 9 may be separated into a plurality of layers.

The intermediate layer 9 is formed with thick parts 12 on prescribed portions in the width of the belt 2. Generally in the shoe press shown in FIG. 1, the outer peripheral surface of the belt 2 readily cracks in regions corresponding to axial ends 13 of the pressure shoe 3 or regions corresponding to axial ends 14 of the press roll 1. When the thickness of the intermediate layer 9 is increased on such portions subjected to concentrated cracking beyond those of the remaining portions, therefore, a crack can be prevented from progressing into the belt 2. The portions subjected to cracking may vary with the type of the apparatus employing the belt 2. In this case, an effect similar to the above can be attained by forming the thick parts 12 on the intermediate layer 9 in prescribed portions subjected to cracking. The thickness of the thick portions 12 from the interface between the intermediate layer 9 and the surface layer 7 is preferably set to 0.3 mm to 2 mm, although this height is not particularly restricted.

The surface layer 7 is provided with thin parts. 15 reduced in thickness in the belt thickness direction, in portions corresponding to the said thick parts 12. The sum of the thicknesses of the thick parts 12 and the thin parts 15 preferably coincided with the thickness of the surface layer 7. In this case, the thickness of the belt 2 is substantially uniform over the region allowing passage of the material web 5, the regions corresponding to the ends 14 of the press roll 1 and the regions corresponding to the ends 13 of the pressure shoe 3.

In the papermaking elastic belt according to the present invention, the elastic material is prepared from thermosetting polyurethane. This polyurethane is made of a composition containing a urethane prepolymer having isocyanate groups (NCO) on ends and a hardener having active hydrogen groups (H) on ends. The urethane prepolymer is obtained by reacting polyol and a phenylene isocyanate derivative with each other.

The polyol for obtaining the urethane prepolymer is selected from polyether polyol and polyester polyol. Polyethylene glycol (PEG), polypropylene glycol (PPG), polytetramethylene glycol (PTMG) or the like can be listed as polyether polyol, for example. Polycaprolactone ester, polycarbonate, polyethylene adipate, polybutylene adipate, polyhexene adipate or the like can be listed as polyester polyol. These can be individually employed or at least two may be mixed or polymerized with each other, while a modified body thereof can also be employed.

Tolylene diisocyanate (TDI), diphenylmethane diisocyanate (MDI), m-xylene diisocyanate (m-XDI), naphthalene diisocyanate (NDI) or the like can be listed as the phenylene isocyanate derivative for obtaining the urethane prepolymer, for example. These can be individually employed or at least two can be mixed with each other.

The hardener can be employed as a mixture of one or at least two of polyol, aromatic diol and aromatic diamine hardeners generally usable as hardeners for polyurethane. That illustrated as the said polyol can be used as the polyol hardener. Hydroquinone di(β-hydroxyethyl) ether can be listed as the aromatic diol hardener. 4,4'-methylene-bis-(2-chloroaniline, trimethylene-bis(4-aminobenzoate), diethyltoluenediamine, dimethylthiotoluenediamine or the like can be listed as the aromatic diamine hardener.

According to recognition of the inventors, dimethylthiotoluenediamine, an aromatic diamine hardener, is preferably employed as the hardener for the polyurethane forming the surface layer 7. Thus, the surface of the papermaking belt is hardly cracked. This dimethylthiotoluenediamine can be prepared from 3,5-dimethylthio-2,4-toluenediamine expressed in the following chemical formula (1):

Chemical Formula (1)

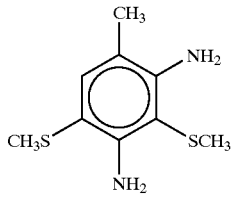

The dimethylthiotoluenediamine can alternatively be prepared from 3,5-dimethylthio-2,6-toluenediamine expressed in the following chemical formula (2):

Chemical Formula (2)

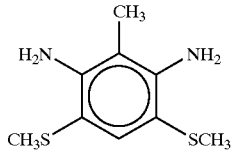

3,5-dimethylthio-2,4-toluenediamine and 3,5-dimethylthio-2,6-toluenediamine can be used individually or as a mixture. A mixture of 3,5-dimethylthio-2,4-toluenediamine and 3,5-dimethylthio-2,6-toluenediamine, put on the market as "ETHACURE 300" from ALBEMARLE Corporation, can be listed as a particularly preferable hardener.

When the hardener for the polyurethane forming the surface layer 7 is mainly composed of the aforementioned dimethylthiotoluenediamine (occupying at least 50% of the number of the active hydrogen groups (H) of the hardener), one or at least two types of hardeners such as polyol and aromatic diamine hardeners may be mixed thereto.

The elastic material forming the intermediate layer 9 is preferably made of a low-hardness elastic material having relatively low hardness, and the elastic material forming the surface layer 7 is preferably made of a high-hardness elastic material having relatively high hardness.

When the intermediate layer 9 is made of the low-hardness elastic material, progress of a crack can be stopped on the portion of the intermediate layer 9 even if the surface of the belt 2 is cracked. In particular, the thick parts 12 are provided on the intermediate layer 9 in the portions readily subjected to concentrated cracking as described above thereby increasing the thickness of the intermediate layer 9 while reducing the thickness of the surface layer 7, whereby progress of a crack can be stopped in the vicinity of the surface of the belt 2. On the other hand, the surface of the belt 2 requires mechanical strength, and hence it is preferable to use the high-hardness material for the surface layer 7. Particularly in the range of the width of the material web 5, processibility for the material web 5 deteriorates if portions having low hardness are too large in thickness. In the range of the width allowing passage of the material web 5, therefore, the thickness of the intermediate layer 9 is reduced and the thickness of the surface layer 7 is increased, for maintaining the processibility for the material web 5. Even if cracking is caused in the range of the width of the material web 5, the progress of a crack can be prevented on the portion of the intermediate layer 9.

In particular, the durometer hardness of the low-hardness elastic material used for the intermediate layer 9 is preferably A80 to A88 (JIS K6253), and the durometer hardness of the high-hardness elastic material used for the surface layer 7 is preferably A93 to A99. If the hardness of the intermediate layer 9 is lower than A80, delamination readily takes place due to the weakness of the intermediate layer 9. If the hardness of the intermediate layer 9 is higher than A88, the fabric base is worn and broken, to readily cause delamination. If the hardness of the surface layer 7 is lower than A93, the processibility for the material web 5 deteriorates. When grooves are formed on the surface of the belt 2, the grooves are deformed and crushed during pressing if the hardness of the surface layer is lower than A93, to reduce dehydration performance. If the hardness of the surface layer 7 is larger than A99, the belt 2 is so inferior in flexibility that cracking readily takes place.

Figure 3:
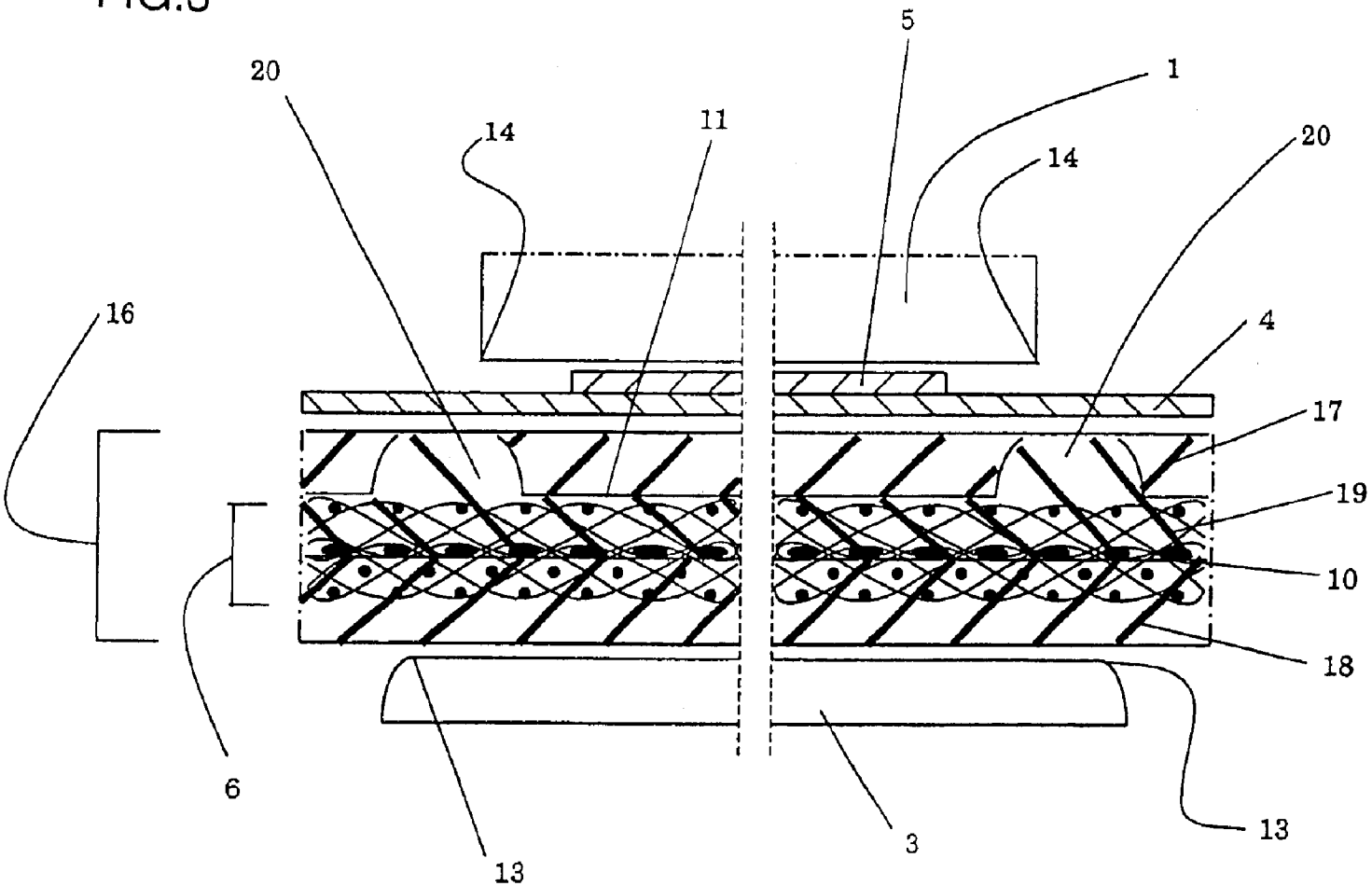
FIG. 3 is a sectional view of a principal part of a shoe press employing a papermaking elastic belt according to another embodiment of the present invention as viewed from the traveling direction.

FIG. 3 shows another embodiment of the papermaking elastic belt according to the present invention. In a papermaking elastic belt 16 shown in FIG. 3, thick parts 20 are exposed on the surface of the papermaking elastic belt 16 through a surface layer 17. The thickness of the belt 16 is substantially uniform over a region allowing passage of a material web 5, regions corresponding to axial ends 13 of a pressure shoe 3 and regions corresponding to axial ends 14 of a press roll 1. In the belt 16 shown in FIG. 3, the thickness of an intermediate layer 19 is increased to form the thick parts 20 and partially eliminate the surface layer 17 in portions readily subjected to concentrated cracking, whereby cracking is seldom caused and the progress of a crack can be stopped in the vicinity of the surface of the belt 16.

Figure 4:
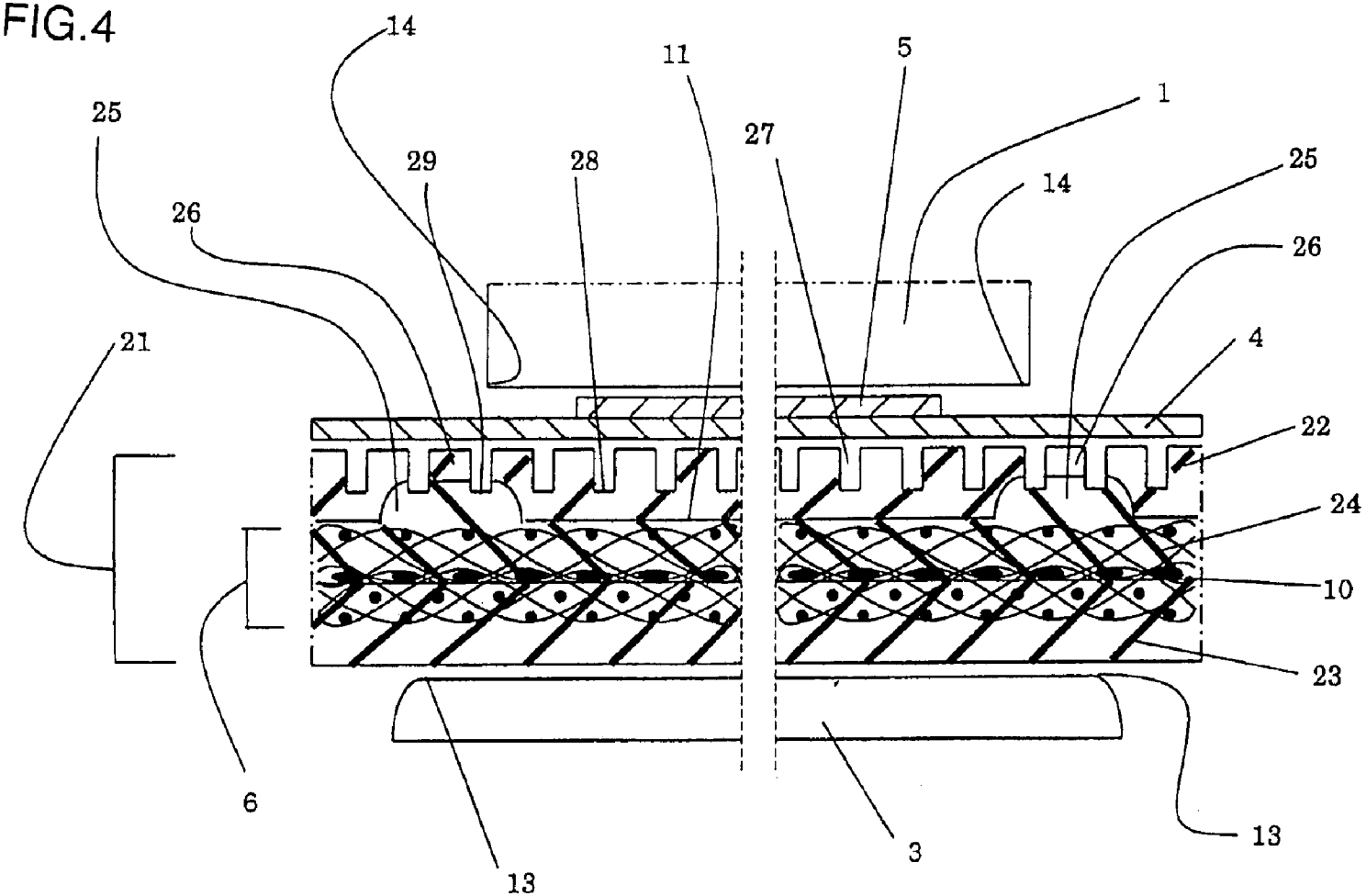
FIG. 4 is a sectional view of a principal part of a shoe press employing a papermaking elastic belt according to still another embodiment of the present invention as viewed from the traveling direction.

FIG. 4 shows still another embodiment of the papermaking elastic belt according to the present invention. In this example, a large number of grooves 27 are formed on the outer peripheral surface of an elastic belt 21 along the traveling direction of the belt, in order to improve the dehydration efficiency. If the bottoms of the grooves 27 reach the intermediate layer 24 of low hardness in a region allowing for the passage of a material web 5 in this case, the grooves 27 are deformed and crushed during pressing to cause a deterioration in the dehydration performance. In the range of the width of the material web 5, therefore, the thickness of the intermediate layer 24 is reduced and the thickness of a surface layer 22 of high hardness is increased for locating bottoms 28 of the grooves 27 in the surface layer 22. Thus, processibility for the material web 5 can be improved.

In regions corresponding to axial ends 13 of a pressure shoe 3 or regions corresponding to axial ends 14 of a press roll 1, on the other hand, thick parts 25 are formed on the intermediate layer 24 and thin parts 26 are formed in corresponding portions of the surface layer 22, for locating bottoms 29 of the grooves 27 in the thick parts 25 of the intermediate layer 24. In general, cracking is readily caused from the bottoms of the grooves 27. In the belt 21 shown in FIG. 4, the bottoms 29 of the grooves 27 are located in the intermediate layer 24 in regions readily subjected to cracking, whereby cracking from the bottoms 29 of the grooves 27 can be suppressed. In the portions forming the thick parts 25 on the intermediate layer 24, the depth of the grooves 27 may be increased beyond that of the remaining portions so that the bottoms 29 of the grooves 27 reach the intermediate layer 24. A large number of blind holes may be provided on the outer peripheral surface of the belt in place of the grooves 27 or along with the grooves 27. The term "blind holes" stands for non-through holes.

In the belt shown in each of FIGS. 2 to 4, about half the thickness of the reinforcing substrate 6 closer to the surface is located in the intermediate layer 9, 19 or 24. Therefore, strong adhesion can be attained between the reinforcing substrate 6 and the intermediate layer 9, 19 or 24, so that the belt can be prevented from delamination. Further, the intermediate layer 9, 19 or 24 infiltrating into the reinforcing substrate 6 is made of the low-hardness elastic material having relatively low hardness of A80 to A88, whereby the reinforcing substrate 6 can be prevented from breakage due to the action of the intermediate layer 9, 19 or 24 serving as a kind of cushioning medium. In order to attain this effect, the reinforcing substrate 6 must be at least partially located in the intermediate layer 9, 19 or 24. The reinforcing substrate 6 may be entirely located in the intermediate layer 9, 19 or 24.

In the example shown in each of FIGS. 2 to 4, part of the reinforcing substrate 6, i.e., about half the back surface is located in the back layer 8, 18 or 23. Therefore, strong adhesion can be attained also between the reinforcing substrate 6 and the back layer 8, 18 or 23. The back layer 8, 18 or 23 and the intermediate layer 9, 19 or 24 are located in the reinforcing substrate 6 from both surfaces of the reinforcing substrate 6, and adhere to each other substantially at the center of the reinforcing substrate 6. Therefore, strong adhesion is attained between the back layer 8, 18 or 23, the reinforcing substrate 6 and the intermediate layer 9, 19 or 24, so that the belt can be prevented from delamination. When the back layer 8, 18 or 23 is also made of a low-hardness elastic material having relatively low durometer hardness of A80 to A88 similarly to the intermediate layer 9, 19 or 24, it follows that the overall reinforcing substrate 6 is impregnated or covered with low-hardness elastic- materials, so that the reinforcing substrate 6 can be more effectively prevented from breakage and the durability of the belt 2, 16 or 21 can be further improved.

The belt shown in FIG. 2 can be manufactured as follows: First, the fabric base 6 consisting of multi-woven endless fabric is turned inside out. The surface of the fabric base 6 defining the back surface is coated with polyurethane for the back layer 8 so that this polyurethane infiltrates into a portion substantially half the fabric base 6. This polyurethane is hardened at a temperature of 70° C. to 100° C. Thereafter the back layer 8 is cut and ground for setting the thickness of a portion not located in the fabric base 6 to a prescribed size (e.g., 0.5 mm to 2 mm).

Then, the fabric base 6 is reversed and the surface thereof is coated with polyurethane for the intermediate layer 9 so that this polyurethane fills up the remaining portion of the fabric base 6. The coated surface is smoothed with a doctor blade or the like. Further, the regions corresponding to the axial ends 13 of the pressure shoe 3 or the regions corresponding to the axial ends 14 of the press roll 1 are additionally coated with polyurethane for the intermediate layer 9, and the thick parts 12 are formed on these portions.

Then, the intermediate layer 9 is coated with polyurethane for the surface layer 7. Then, the whole is heated to a temperature of 120° C. to 140° C. for hardening the polyurethane forming the intermediate layer 9 and the surface layer 7 applied onto the outer peripheral surface of the back layer 8 while bonding and integrating the overall layers to and with each other.

Finally, the surface layer 7 is cut and ground to set the thickness of the portion of the polyurethane, forming the belt 2, not located in the fabric base 6 to a prescribed size (e.g., 0.5 mm to 2 mm).

Figure 5:
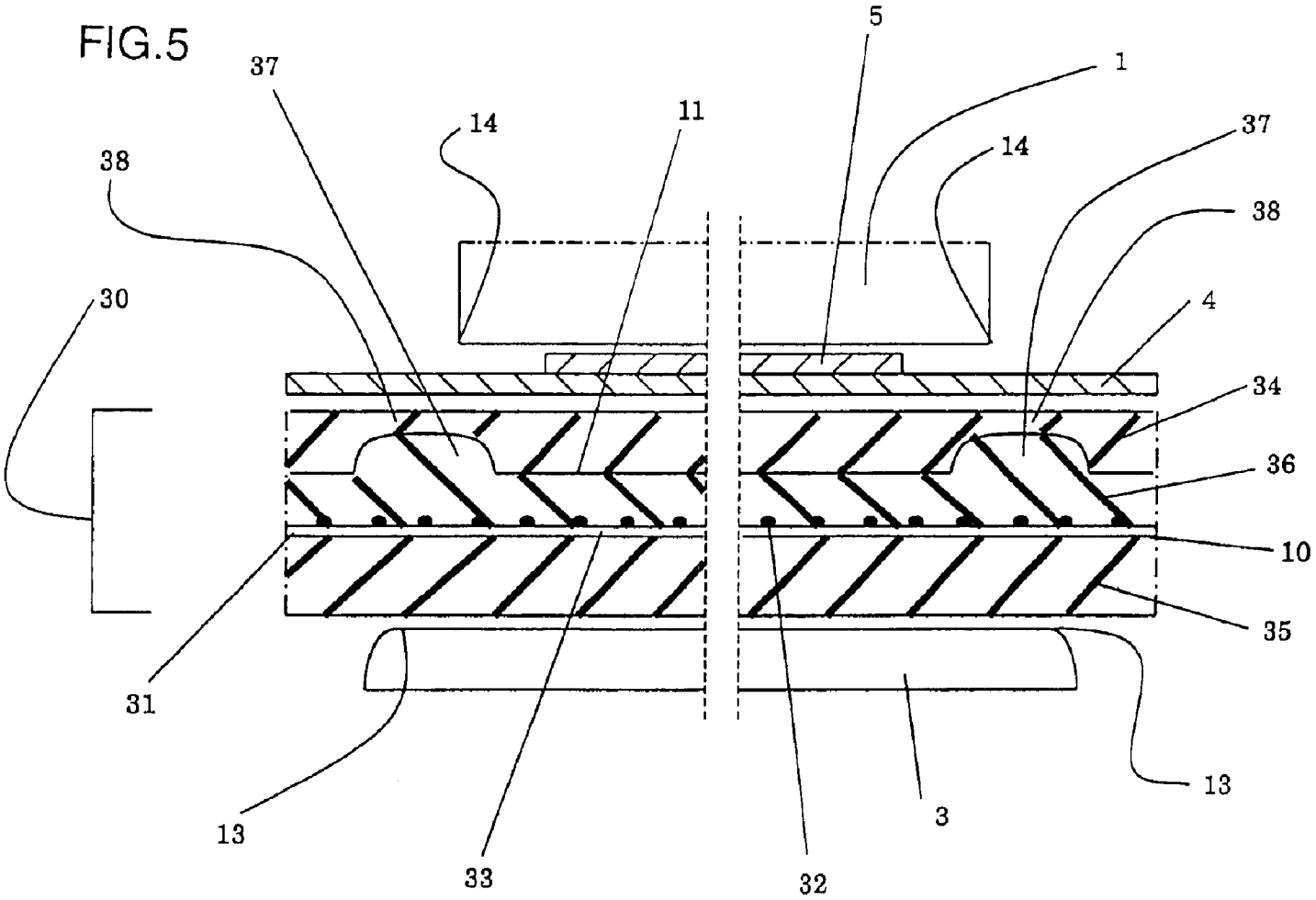
FIG. 5 is a sectional view of a principal part of a shoe press employing a papermaking elastic belt according to a further embodiment of the present invention as viewed from the traveling direction.

FIG. 5 shows a further example of the papermaking elastic belt according to the present invention. The difference between a belt 30 shown in FIG. 5 and the belt 2 shown in FIG. 2 resides in that a reinforcing yarn 31 is employed in place of the woven fabric 6 as a reinforcing substrate.

The reinforcing yarn 31 is formed by yarns 32 in the belt traveling direction (hereinafter referred to as a "MD") and yarns 33 in a direction perpendicular thereto (hereinafter referred to as a "CMD"). A large number of yarns 32 in the MD and a large number of yarns 33 in the CMD are arranged substantially at regular intervals. The material for the yarns is polyamide, aromatic polyamide, polyester or the like, for example. The reinforcing yarn 31 is embedded in an elastic material.

The elastic material is formed by a surface layer 34, a back layer 35 and an intermediate layer 36. Similarly to the belt shown in FIG. 2, thick parts 37 are formed on prescribed portions of the intermediate layer 36 in the width direction of the belt, while thin parts 38 are formed on portions of the surface layer 34 corresponding to the thick parts 37. The elastic material for each layer is similar to that in the example shown in FIG. 2.

Also in this example, the intermediate layer 36 is made of a low-hardness elastic material so that progress of a crack can be stopped in the portion of the intermediate layer 36 even if the surface of the belt 30 is cracked. Further, the thickness of the intermediate layer 36 is increased in portions readily subjected to concentrated cracking and the thin parts 38 are provided on the surface layer 34 thereby reducing the thickness of the surface layer 34, whereby progress of a crack can be stopped in the vicinity of the surface of the belt 30. In addition, the thickness of the intermediate layer 36 is reduced and the thickness of the surface layer 34 having high hardness is increased in the range of the width of a material web 5, whereby processibility for the material web 5 can be maintained. Even if cracking is caused in the range of the width of the material web 5, progress of a crack can be prevented on the portion of the intermediate layer 36.

As a modification of the belt shown in FIG. 5, the thick parts of the intermediate layer may be exposed on the surface of the belt through the surface layer as shown in FIG. 3, or a large number of grooves may be formed on the outer peripheral surface of the belt as shown in FIG. 4.

In the belt 30 shown in FIG. 5, the reinforcing yarn 31 is entirely or partially located in the intermediate layer 36. In this example, the reinforcing yarn 31 is at least partially located in the intermediate layer 36 consisting of a low-hardness elastic material having relatively low hardness similarly to the intermediate layer 9 in the example shown in FIG. 2, whereby the reinforcing yarn 31 can be prevented from breakage. Since the intermediate layer 36 is made of the low-hardness elastic material, the elastic material can be prevented from breakage such as cracking. Therefore, durability of the belt 30 can be improved.

The belt 30 shown in FIG. 5 can be manufactured as follows: First, a mandrel is coated with polyurethane for the back layer 35 in a prescribed thickness (e.g., 2 mm to 3 mm), and this polyurethane is hardened at a temperature of 70° C. to 100° C. for forming the back layer 35.

Then, the yarns 33 in the CMD and the yarns 32 in the MD are wound on the outer peripheral surface of the back layer 35 as the reinforcing yarn.

Then, the reinforcing yarn 31 is coated with polyurethane for defining the intermediate layer 36. The coated surface is smoothed with a doctor blade or the like. Further, regions corresponding to axial ends 13 of a pressure shoe 3 or regions corresponding axial ends 14 of a press roll 1 are additionally coated with polyurethane for the intermediate layer 36, and the thick parts 37 are formed on these portions.

Further, the intermediate layer 36 is coated with polyurethane for the surface layer 34. Then, the whole is heated to a temperature of 120° C. to 140° C., for hardening the polyurethane forming the intermediate layer 36 and the surface layer 34 applied onto the outer peripheral surface of the back layer 35 while bonding and integrating the overall layers to and with each other.

Finally, the surface layer 34 is cut and ground to set the thickness of the overall belt 30 to a prescribed size (e.g., 5 mm to 6 mm).

While the above description has been made with reference to a shoe press elastic belt employed in a press step of a paper machine, the papermaking elastic belt according to the present invention is also generally usable as a papermaking elastic belt such as a calender elastic belt or a sheet transfer elastic belt.

(EXAMPLE)

As Example, the papermaking elastic belt shown in FIG. 2 was manufactured in the following procedure:

An endless fabric base 6 consisting of quadruple layer woven fabric was prepared as the reinforcing substrate. This fabric base 6 was 2.3 mm in thickness, and had voids therein. As to the structure of the fabric base 6, warps of the MD consisted of four layers of polyester monofilaments of 0.35 mm in diameter, polyester multifilaments of 3000 d, polyester monofilaments of 0.35 mm in diameter and nylon monofilaments of 0.35 mm in diameter successively from the surface side and wefts of the CMD consisted of polyester monofilaments of 0.40 mm in diameter. The number of the warps was 68/inch, and the number of the wefts was 56/inch.

As the material for defining the back layer 8, 100 parts by weight of a urethane prepolymer (PTMG/MDI: NCO %=5%) and 25.3 parts by weight of a hardener (prepared by blending PTMG and ETHACURE 300 in a ratio of 65/35: equivalent=219) were individually defoamed and thereafter mixed with each other. The surface of the fabric base 6 turned inside out was coated with this mixture, which in turn was heated under a temperature condition of 80° C. for 10 hours. The fabric base 6 was impregnated with the back layer 8 up to 50% of the thickness thereof.

Then, the back layer 8 covering the fabric base 6 was cut and ground to set the thickness from the surface of the fabric base 6 to 1.0 mm. Thereafter the fabric base 6 was reversed to direct the coated surface inward.

Then, as the material for defining the intermediate layer 9, the other surface of the fabric base 6 was coated with polyurethane of the same composition as that for the back layer 8 and impregnated with the polyurethane up to the surface impregnated with the back layer 8. The coated surface was smoothed with a doctor blade to be substantially flush with the position of the surface of the fabric base 6. Further, the regions corresponding to the axial ends of the pressure shoe 3 and the press roll 1 were additionally coated with polyurethane for the intermediate layer 9, for forming the thick parts 12 of 0.7 mm in height along the MD.

For the surface layer 7, 100 parts by weight of a urethane prepolymer (PTMG/TDI: NCO %=6.6%) and 18.2 parts by weight of a hardener (ETHACURE 300: equivalent: 107) were individually defoamed and thereafter mixed with each other, for coating the intermediate layer 9 with this mixture.

Thereafter heating was performed under a temperature condition of 120° C. for 16 hours, for bonding and integrating the back layer 8, the intermediate layer 9, the surface layer 7 and the fabric base 6 to and with each other.

Further, the surface of the belt was cut and ground to set the thickness of the surface layer 7 to 1.5 mm. In the obtained belt, the overall thickness was 4.8 mm, the hardness of the back layer 8 and the intermediate layer 9 was A85, and the hardness of the surface layer 7 was A95.

Each of samples 1 to 14 for a comparison test was prepared as follows: A fabric base consisting of the same quadruple layer woven fabric as that employed for the aforementioned Example was prepared as the reinforcing substrate. As the material for forming the back layer, a urethane prepolymer (PTMG/MDI: NCO %=5%) and a hardener (obtained by blending PTMG having average molecular weight of 1000 and ETHACURE 300) were individually defoamed and thereafter mixed with each other at a ratio varying with each sample, to attain hardness shown in Table 1. The back surface of the fabric base was coated with this mixture, and heating was performed under a temperature condition of 80° C. for 10 hours. The fabric base was impregnated with the polyurethane for forming the back layer up to half the thickness thereof Then, the polyurethane layer covering the fabric base was cut and ground to set the thickness from the surface of the fabric base to 1.0 mm.

Then, as the material for forming the intermediate layer, the opposite surface of the back layer was coated with polyurethane of the same composition as that for the back layer and impregnated with this polyurethane up to an impregnated surface thereof. The thickness of the intermediate layer was set to up to the surface of the fabric base or to 0.7 mm from the surface of the fabric base, as shown in Table 1.

As to the material for forming the surface layer, further, the intermediate layer was coated with polyurethane prepared by mixing 100 parts by weight of a urethane prepolymer (PTMG/TDI: NCO %=6.6%) and 18.2 parts by weight of a hardener (ETHACURE 300: equivalent=107) as to each of the samples 1 to 3, 5, 6, 8, 9 and 11 to 14. As to each of the samples 4, 7 and 10, the intermediate layer was coated with polyurethane prepared by mixing 100 parts by weight of a urethane prepolymer (PTMG/TDI: NCO %=5.3%) and 14.6 parts by weight of a hardener (ETHACURE 300: equivalent=107) with each other. Table 1 describes the thickness of the surface layer in each sample.

Thereafter heating was performed under a temperature condition of 120° C. for 16 hours, for bonding and integrating the back layer, the intermediate layer, the surface layer and the fabric base to and with each other. Further, the surface of the belt was cut and ground to set the overall thickness to 4.8 mm, for obtaining each sample.

As to each sample (samples 3, 4, 6, 7, 9, 10 and 12) having the intermediate layer in a thickness of up to 0.7 mm from the surface of the fabric base, thick parts on prescribed portions of the papermaking belt were assumed.

As to each of the aforementioned samples, crack propagation resistance was tested with a de Mattia machine defined in JIS K6260 under the following conditions: The test piece was 20 mm in width and 150 mm in length. Reciprocating motion was at a maximum distance of 80.5 mm, a minimum distance of 38.5 mm and a motion distance of 42.0 mm. A notch was formed on the outer surface of an end of the test piece in the width direction at the longitudinal center with a length of 3 mm and a depth of 1.5 mm. The test piece was bent 1000 times under these conditions, for thereafter measuring the magnitude of cracking. Table 1 shows the results in the item of Length of Progress of Cracking.

Figure 6:
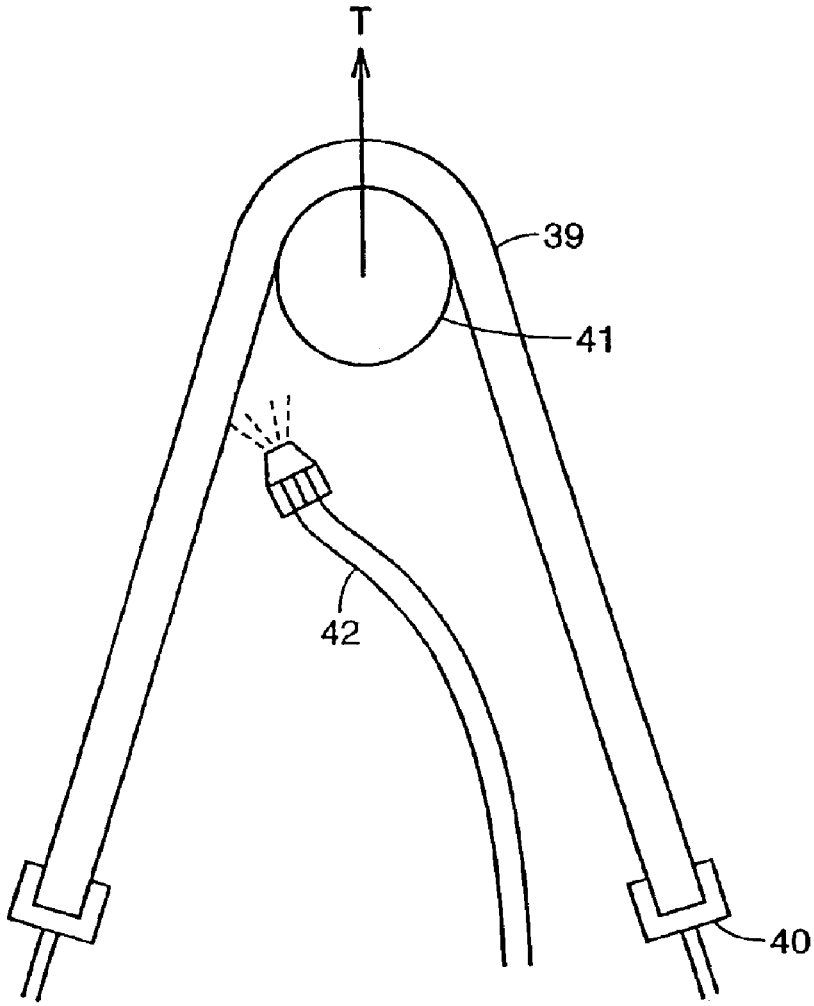
FIG. 6 is a diagram illustrating a tester for a peeling/durability test.

Then, a test piece 39 of 20 mm in width and 420 mm in length was obtained from each of the aforementioned samples. As shown in FIG. 6, both longitudinal ends of each test piece 39 were gripped with gripping members 40 for bringing a metal round bar 41 of 25 mm in diameter having a smooth surface into contact with the inner side of an intermediate portion and applying tension of 9.8 kN/m. The

TABLE 1

| | Back Layer | | Intermediate Layer | | Surface Layer | | | Length of Progress |
|---|---|---|---|---|---|---|---|---|
| | Hardness (JIS A) | Thickness | Hardness (JIS A) | Thickness | Hardness (JIS A) | Thickness | Peeling/Durability Test | of Cracking (mm/1000 bends) |
| Sample 1 | 79 | 1/2 of fabric base + 1 mm | 79 | 1/2 of fabric base | 95 | 1.5 | peeled by breakage of intermediate layer | 1.0 |
| Sample 2 | 80 | 1/2 of fabric base + 1 mm | 80 | 1/2 of fabric base | 95 | 1.5 | not peeled | 1.0 |
| Sample 3 | 80 | 1/2 of fabric base + 1 mm | 80 | 1/2 of fabric base + 0.7 mm | 95 | 0.8 | not peeled | 0.3 |
| Sample 4 | 80 | 1/2 of fabric base + 1 mm | 80 | 1/2 of fabric base + 0.7 mm | 93 | 0.8 | not peeled | 0.2 |
| Sample 5 | 85 | 1/2 of fabric base + 1 mm | 85 | 1/2 of fabric base | 95 | 1.5 | not peeled | 1.1 |
| Sample 6 | 85 | 1/2 of fabric base + 1 mm | 85 | 1/2 of fabic base + 0.7 mm | 95 | 0.8 | not peeled | 0.3 |
| Sample 7 | 85 | 1/2 of fabric base + 1 mm | 85 | 1/2 of fabric base + 0.7 mm | 93 | 0.8 | not peeled | 0.2 |
| Sample 8 | 88 | 1/2 of fabric base + 1 mm | 88 | 1/2 of fabric base | 95 | 1.5 | not peeled | 1.2 |
| Sample 9 | 88 | 1/2 of fabric base + 1 mm | 88 | 1/2 of fabric base + 0.7 mm | 95 | 0.8 | not peeled | 0.4 |
| Sample 10 | 88 | 1/2 of fabric base + 1 mm | 88 | 1/2 of fabric base + 0.7 mm | 93 | 0.8 | not peeled | 0.3 |
| Sample 11 | 90 | 1/2 of fabric base + 1 mm | 90 | 1/2 of fabric base | 95 | 1.5 | peeled by breakage of fabric base | 1.3 |
| Sample 12 | 90 | 1/2 of fabric base + 1 mm | 90 | 1/2 of fabric base + 0.7 mm | 95 | 0.8 | peeled by breakage of fabric base | 0.5 |
| Sample 13 | 93 | 1/2 of fabric base + 1 mm | 93 | 1/2 of fabric base | 95 | 1.5 | peeled by breakage of fabric base | 1.4 |
| Sample 14 | 95 | 1/2 of fabric base + 1 mm | 95 | 1/2 of fabric base | 95 | 1.5 | peeled by breakage of fabric base | 1.5 |

test piece 39 was repetitively reciprocated with a width of 10 cm while keeping the tension and supplying lubricating oil between the inner surface of the test piece 39 and round bar 41 from a nozzle 42. According to this method, sliding was repeated between the inner surface and the round bar 41 while applying the tension to the test piece 39. After repeating the reciprocating motion 5 million times, the sample was detached for visually observing presence/absence of delamination. Table 1 shows the results in the item of Peeling/Durability Test.

As shown in Table 1, the size of cracking after 1000 bends in the test of the length of progress of cracking was at least 1 mm in each sample (samples 1, 2, 5, 8, 11, 13 and 14) provided with no thick parts while an excellent result of not more than 0.5 mm was attained in each sample (samples 3, 4, 6, 7, 9, 10 and 12) provided with the thick parts. When the intermediate layer was made of a low-hardness elastic material having durometer hardness (JIS K6253) of A80 to A88 and the surface layer was made of a high-hardness elastic material having durometer hardness (JIS K6253) of A93 to A99 while providing the thick parts (samples 3, 4, 6, 7, 9 and 10), not only a more excellent effect reducing the size of cracking to not more than 0.4 mm was attained in the test of the length of progress of cracking but also no delamination was detected in the peeling/durability test.

The embodiments and Example disclosed this time must be considered illustrative in all points and not restrictive. The scope of the present invention is shown not by the above description but by the scope of claim for patent, and it is intended that all modifications in the meaning and range equivalent to the scope of claim for patent are included.

Industrial Applicability

In the papermaking elastic belt according to the present invention comprising a reinforcing substrate embedded in an elastic material, the said elastic material includes a surface layer, a back layer and an intermediate layer located between the said surface layer and the said back layer and a thick part having a thickness in the thickness direction of the belt along the belt traveling direction is provided on the said intermediate layer, whereby a crack can be prevented from progressing into the belt even if the paper making elastic belt is cracked. Particularly when the said intermediate layer is made of a low-hardness elastic material having durometer hardness (JIS K6253) of A80 to A88 and the said surface layer is made of a high-hardness elastic material having durometer hardness (JIS K6253) of A93 to A99, the reinforcing substrate can be prevented from breakage and durability of the belt can be improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A papermaking elastic belt comprising a reinforcing substrate disposed in an elastic material, said elastic material including a surface layer, a back layer and an intermediate layer located between said surface layer and said back layer, said intermediate layer containing a thick part having a thickness in the belt thickness direction along the belt traveling direction, said thick part of the intermediate layer being formed in at least one of a region corresponding to an axial end of a pressure shoe and a region corresponding to an axial end of a press roll.

2. The papermaking elastic belt according to claim 1, having a thin part located on the surface side of said thick part and reduced in thickness in the belt thickness direction in said surface layer.

3. The papermaking elastic belt according to claim 1, wherein said thick part is exposed on the belt surface through said surface layer.

4. The papermaking elastic belt according to claim 1, wherein the intermediate layer is made of a low-hardness elastic material, and the surface layer is made of a high-hardness elastic material.

5. The papermaking elastic belt according to claim 4, wherein durometer hardness (JIS K6253) of the low-hardness elastic material is A80 to A88, and the durometer hardness (JIS K6253) of high-hardness elastic material is A93 to A99.

6. The papermaking elastic belt according to claim 1, wherein grooves are formed on the outer peripheral surface of elastic belt.

7. The papermaking elastic belt according to claim 6, wherein the bottom of the grooves located above the thick part is present in said intermediate layer, and the bottom of the grooves located in a portion above said thick part is present in said surface layer.

8. The papermaking elastic belt according to claim 1, wherein at least a part of said reinforcing substrate is located in said intermediate layer.

9. The papermaking elastic belt according to claim 8, wherein part of said reinforcing substrate is located in said back layer.

10. The papermaking elastic belt according to claim 1, wherein said papermaking elastic belt is:

an elastic belt used for a papermaking press containing said press roll, the elastic belt positioned opposed to said press roll and said pressure shoe located inside said elastic belt for pressing said elastic belt against said press roll for pressing a material web between said elastic belt and said press roll.

11. A papermaking elastic belt comprising a reinforcing substrate disposed in an elastic material, said elastic material including a surface layer, a back layer and an intermediate layer located between said surface layer and said back layer, said intermediate layer containing a thick part having a thickness in the belt thickness direction along the belt traveling direction, wherein grooves are formed on the outer peripheral surface of the elastic belt, whereby for the grooves located above the thick part, the bottom of the groove is in the intermediate layer, and for the grooves not located above the thick part, the bottom of the groove is in the surface layer.

12. The papermaking elastic belt of claim 1, wherein the thick part of the intermediate layer substantially prevents cracks from progressing into the belt.

* * * * *

UNITED STATES PATENT AND TRADEMARK OFFICE

CERTIFICATE OF CORRECTION

PATENT NO. : 6,921,461 B2
DATED : July 26, 2005
INVENTOR(S) : Atsuo Watanabe et al.

It is certified that error appears in the above-identified patent and that said Letters Patent is hereby corrected as shown below:

Column 14,
Line 28, "the grooves located in a portion above said thick part is" should read
-- the grooves located in a portion not above said thick part is --.

Signed and Sealed this

Sixteenth Day of May, 2006

JON W. DUDAS
*Director of the United States Patent and Trademark Office*